US006254433B1

(12) United States Patent
Morita

(10) Patent No.: US 6,254,433 B1
(45) **Date of Patent: *Jul. 3, 2001**

(54) MULTIPLE POLE CONNECTOR WITH SHIELD PLATE

(75) Inventor: Shigehiro Morita, Tokyo (JP)

(73) Assignee: Hirose Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/315,060

(22) Filed: May 20, 1999

(30) Foreign Application Priority Data

Sep. 30, 1998 (JP) ..... 10-276290

(51) Int. Cl.[7] ..... H01R 4/66
(52) U.S. Cl. ..... 439/607; 439/108
(58) Field of Search ..... 439/607, 608, 439/609, 108

(56) References Cited

U.S. PATENT DOCUMENTS 4,767,342 * 8/1988 Sato ..... 439/83
4,889,959 * 12/1989 Taylor et al. ..... 439/609
5,195,899 * 3/1993 Yatsu et al. ..... 439/108
5,913,690 * 6/1999 Dechelette et al. ..... 439/108

FOREIGN PATENT DOCUMENTS 8-321358 * 12/1996 (JP) ..... H01R/13/652

* cited by examiner

*Primary Examiner*—Tulsidas Patel
(74) *Attorney, Agent, or Firm*—Kanesaka & Takeuchi

(57) ABSTRACT

A multiple pole connector with shield plates comprises a central shield plate (2) provided at the center of and along the length of the connector, a pair of outer shield plates (7) provided on either side of the central shield plate along the length of the connector, a plurality of signal terminals provided between the central and outer shield plates, and a metal support (3) for electrically connecting the central and outer shield plates.

8 Claims, 5 Drawing Sheets

MULTIPLE POLE CONNECTOR WITH SHIELD PLATE

BACKGROUND OF THE INVENTION

1. Field of the Invention

The present invention relates to multiple pole connectors with a shield plate or plates.

2. Description of the Related Art

Japanese patent application Kokai No. 8-321358 discloses a multiple pole connector with a shield plate. This connector comprises a ground plate consisting of a ground plate body section (functioning as a central shield plate) and a ground plate contact section (functioning as ground connection section) and a plurality of signal terminals provided either side of the ground plate boy section. The ground plate contact section (ground connection section) is connected to the ground of a board to not only prevent electromagnetic interference produced by the signal terminals but also support the ground plate body section.

Frequently, it is necessary for the multiple pole connector to change the number of signal terminals. In the above connector wherein the ground plate body section and the ground plate contact section are integrated as a unit, it is difficult to change the number of signal terminals or develop the number of poles (called "pole number development") because the integral structure of the ground plate body and contact sections is complicated. It is necessary to make complicated components in accordance with the pole number development. Since the shield plate is provided only at the center of the connector, the connector has poor ground performance and is vulnerable to electromagnetic interference.

Unlike the above connector, a connector comprising only a pair of outer shield plates without the central shield plate has been developed. This connector, however, has also poor ground performance.

A connector comprising a number of through-holes provided in the central row of a board for connection with the shield plate has been developed. This connector, however, requires a large number of through-holes formed in a narrow area of a board in accordance with the shape of a connector, requiring complicated work.

SUMMARY OF THE INVENTION

Accordingly, it is an object of the invention to provide a multiple pole connector by which the pole number development is made easy.

It is another object of the invention to provide a multiple pole connector having excellent ground performance and resistant to electromagnetic interference.

It is still another object of the invention to provide a multiple pole connector by which ground connection is made possible without through-holes in a board.

According to one aspect of the invention there is provided a multiple pole connector with a shield plate, comprising a central shield plate provided at a center of and along a length of the connector; and a metal support connected to the central shield plate for electrical connecting the central shield plate to a ground of a board.

According to another aspect of the invention there is provided a multiple pole connector with a shield plate, comprising a central shield plate provided at a center of and along a length of the connector; an outer shield plate provided outside of the central shield plate along the length of the connector; and a metal support for electrically connecting the central shield plate to the outer shield plate.

According to one embodiment of the invention, the outer shield plate is electrically connected to a ground of a board.

According to another embodiment of the invention, the metal support is electrically connected to a ground of a board.

According to still another embodiment of the invention, the metal support is fixed to the connector and soldered to a board to thereby reinforce the connector.

DESCRIPTION OF THE PREFERRED EMBODIMENTS

Figure 1:
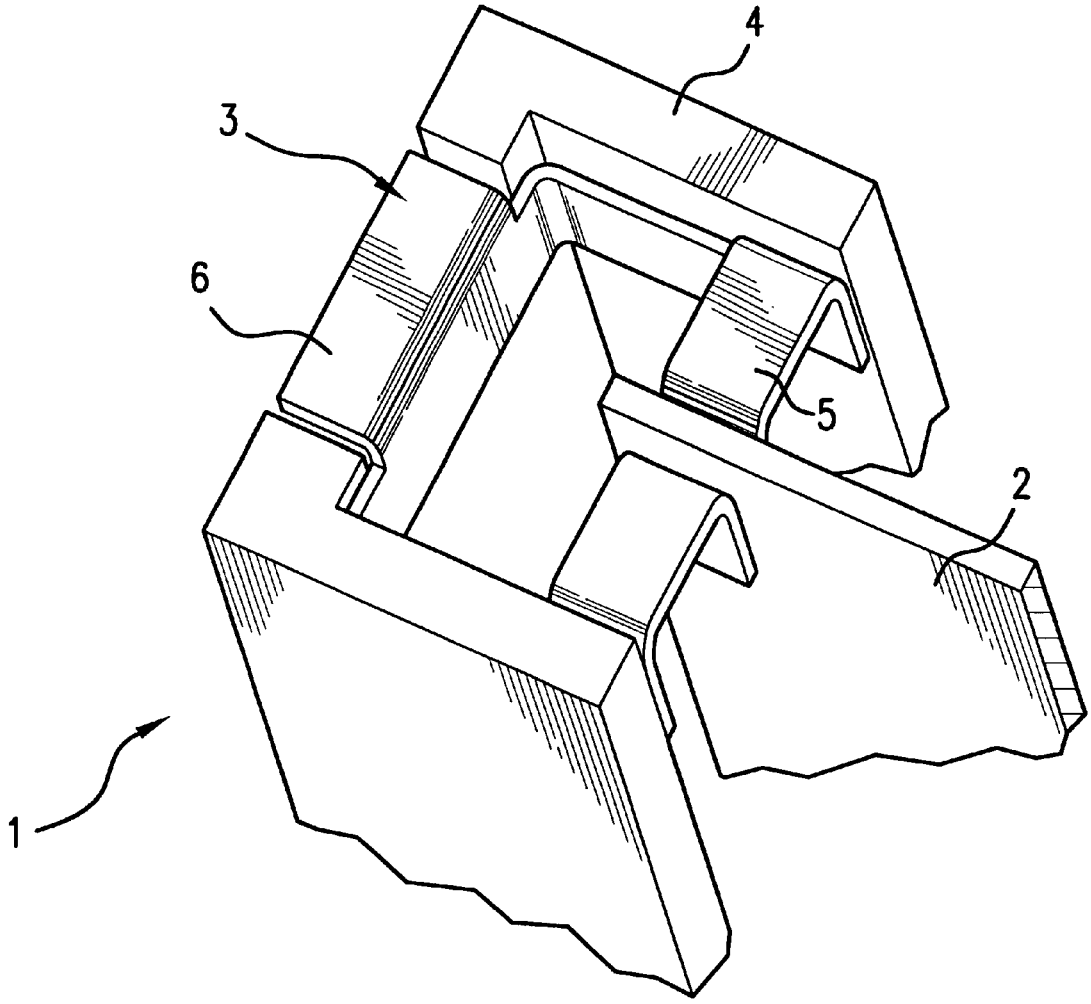
FIG. 1 is a perspective view of part of a multiple pole connector with a shield plate according to an embodiment of the invention.

FIG. 1 shows an end of a multiple pole connector 1 with a shield plate according to an embodiment of the invention. The other end has an identical structure with this one.

The connector 1 comprises a central shield plate 2 extending along the length of the connector, signal terminals (not shown), a reinforcing metallic member 3 connected to an end of the central shield plate 2, and a housing 4 for covering the metallic member 3. The housing 4 also supports the metallic member 3 so that they can be conceived as a unit. As in the conventional connector, the signal terminals are provided on either side of the central shield plate 2 along the length of the connector 1. The signal terminals are soldered to a PC board to fix the connector to the board.

An electric current running through the signal terminals or the outside of the connector causes a variety of electromagnetic interference. Especially when a high frequency signal runs through the signal terminals, the electromagnetic interference becomes severe.

The shield plate 2 is provided to reduce the effects of the electromagnetic interference. It is electrically connected to the ground of a board to discharge the electric current produced by the electromagnetic interference thereby reducing the effects.

As described hereinafter, an outer shield plate may also be provided along with the central shield plate 2. In this embodiment, only the central shield plate is provided in order to simplify the development of a pole number at the expense of reduction of the electromagnetic interference.

The central shield plate 2 prevents the electromagnetic interference of the signal terminals provided on either side of the central shield plate.

The length of the central shield plate 2 can be changed according to the number of required signal terminals or poles (called "pole number development"). The larger the number of poles, the longer the shield plate. Conversely, the smaller the number of poles, the shorter the shield plate. Consequently, if there is a shield plate having a complex shape, such as the afore-mentioned combination type where the central and ground plates are made as a unit, it necessary to provide a number of complicated central shield plates, requiring large amounts of labor.

According to the invention, the central shield plate is simplified, and a support member fixed to the central shield plate is separated from the central shield plate and has a certain shape. That is, the central shield plate 2 has a flat rectangular shape, and the metal member 3 and the housing 4 have certain shapes regardless of the pole number development. If a pole number development is necessary, the lengths of only the central shield plate and the molded body are adjusted, and the metal member 3 and the housing 4 are fixed to the adjusted central shield plate to meet the pole number development. Thus, it is only necessary to change the lengths of the central shield plate 2 and the molded body for the pole number development, while it is not necessary to change the size and shape of the metal member 3 and the housing 4. Since the central shield plate is a flat rectangle, it is easy to change the length.

Figure 2:
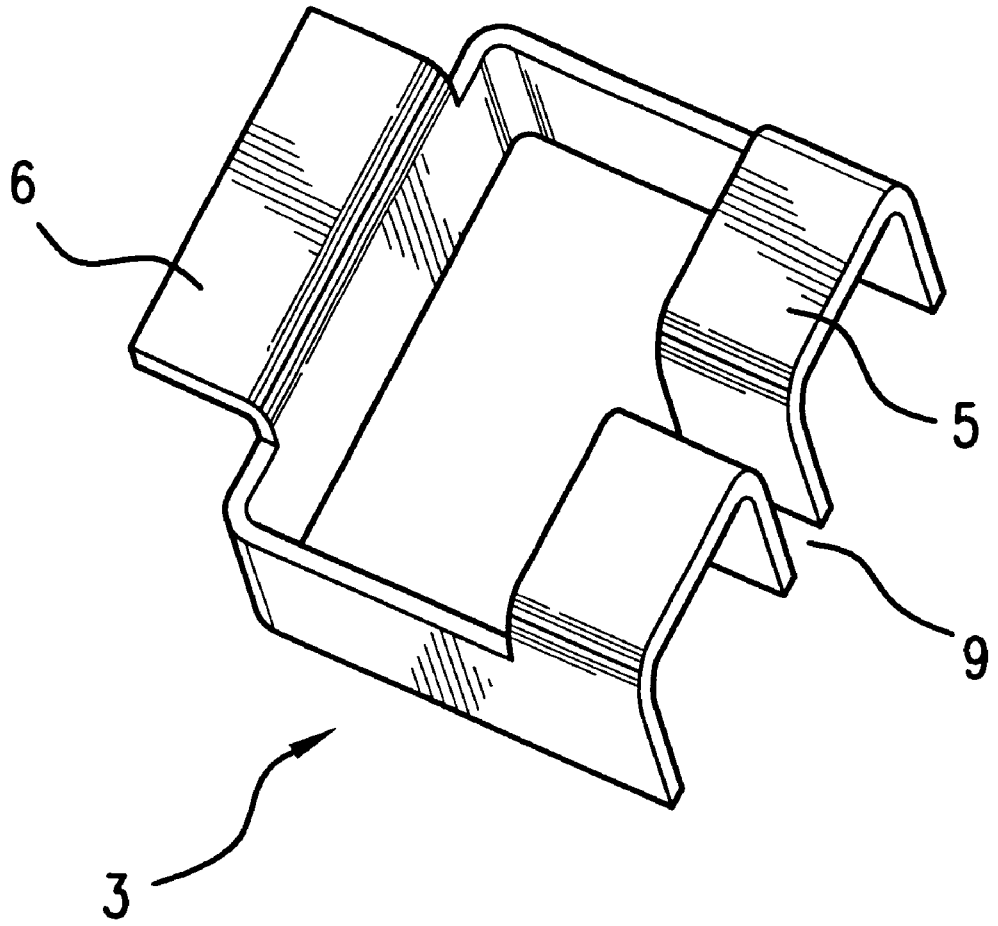
FIG. 2 is a perspective view of a metal support for the connector.

FIG. 2 shows the metal support 3 which has a substantially C-shaped rectangular form. An end of the central shield plate 2 is press fitted into a narrow gap 9 of the metal support 9 to thereby fix the metal support 3 to the central shield plate 2.

As shown in FIG. 1, the resinous housing 4 is attached to the metal support 3 to cover the outside. It is apparent that the length of the central shield plate 2 does not affect the metal support 3 and the housing 4. The connector is fixed to the board by soldering the signal terminal and/or the metal support. Where the metal support is fixed to the board, it reinforces the connection of the connector to the board and can be called "reinforcing member".

The metal support 3 is connected to the central shield plate 2 both mechanically and electrically. Consequently, by electrically connecting the metal support to the ground of the board, it is possible to use the metal support as a ground member for the central shield plate. With the use of the metal support, it is not necessary to provide a through-hole for grounding the central shield plate as in the conventional connector. The metal support is fixed to the board by soldering the press-fit section 5 or the outwardly extended section 6.

Figure 3:
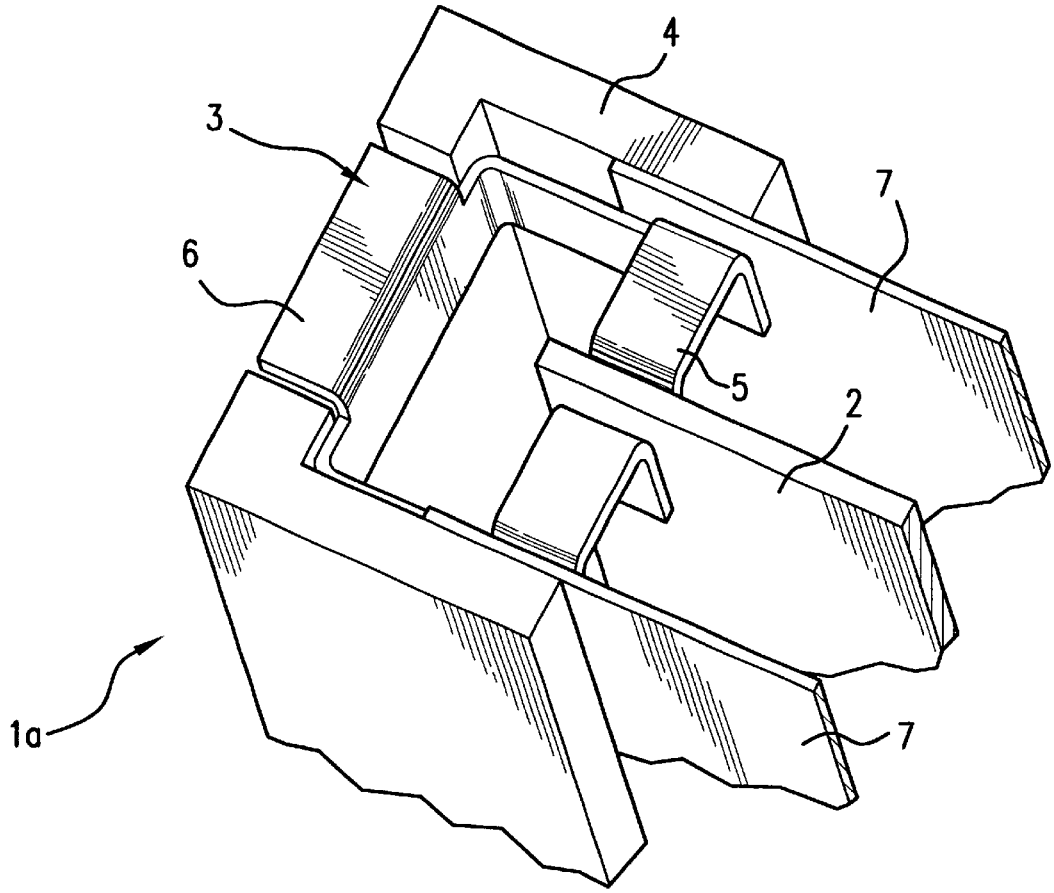
FIG. 3 is a perspective view of part of a multiple pole connector with shield plates according to the second embodiment of the invention.

A multiple pole connector according to the second embodiment of the invention will be described with reference to FIG. 3. A connector 1*a* is provided with a pair of outer shield plates 7 which prevent electromagnetic interference from leaking to the outside or the outside electromagnetic interference from affecting the connector.

The signal terminals are provided between the central shield plate 2 and the outer shield plates 7 along the length of the connector as in the conventional connector. The end of each signal terminal projects outwardly from the outer shield plate 7 while the remaining portion of the signal terminal lies between the central and outer shield plates 2 and 7. The connector is fixed to a board by soldering the signal terminals or the extended section 6 of the metal support.

The central and outer shield plates 2 and 7 are made separately from the metal support 3 and the housing 4 so that it is easy to make pole number development as in the connector of FIG. 1. That is, upon pole number development, it is necessary to adjust only the lengths of the central and outer shield plates 2 and 7 and the molded body while it is not necessary to adjust the metal support 3 and the housing 4. In addition, this connector has a reinforced ground property.

The outer shield plate 7 is held between the press-fit section 5 of the metal support 3 and the housing 4 so that it is electrically connected to the central shield plate 2 and the other outer shield plate 7. Consequently, by electrically connecting the metal support 3 to the ground of a board it is possible to ground both the central and outer shield plates 2 and 7. As a result, the ground property is improved. Either of the press-fit section 5 or the extended section 6 is used to electrically connect the metal support 3. The metal support fixed to the board also serves as a reinforcing member.

Figure 4:
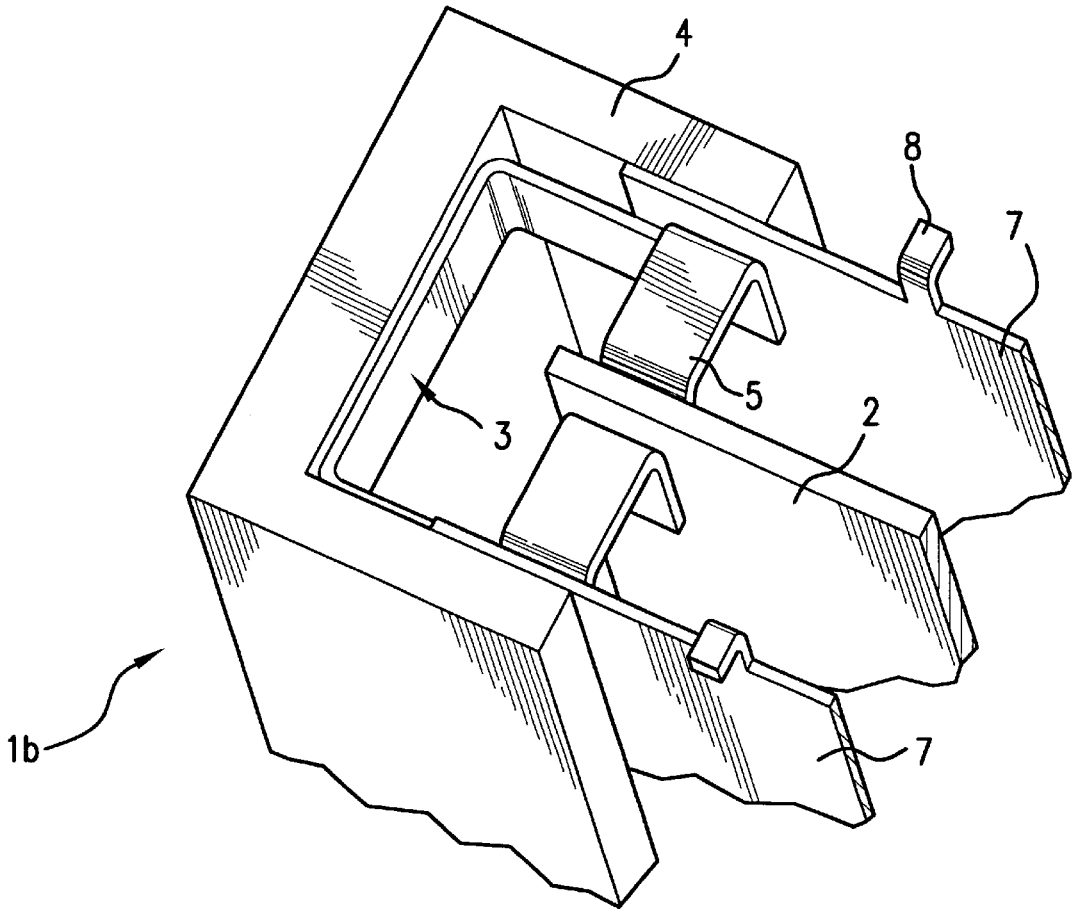
FIG. 4 is a perspective view of part of a multiple pole connector with shield plates according to the third embodiment of the invention.

A multiple pole connector with a shield plate according to the third embodiment of the invention will be described with reference to FIG. 4. This connector 1*b* is different from the connector 1*a* of FIG. 3 in that the metal support 3 does not have any extended section but only the press-fit sections 5 and that a plurality of fixing pieces 8 extend outwardly from the bottom edge of the outer shield plates 7. This connector also facilitates the pole number development and improves the ground property. In this embodiment, the outer shield plates 7 are connected to the board by electrically connecting the fixing pieces 8 to the ground of the board. The fixing pieces 8 soldered to the board also reinforce the connection of the connector to the board.

Figure 5:
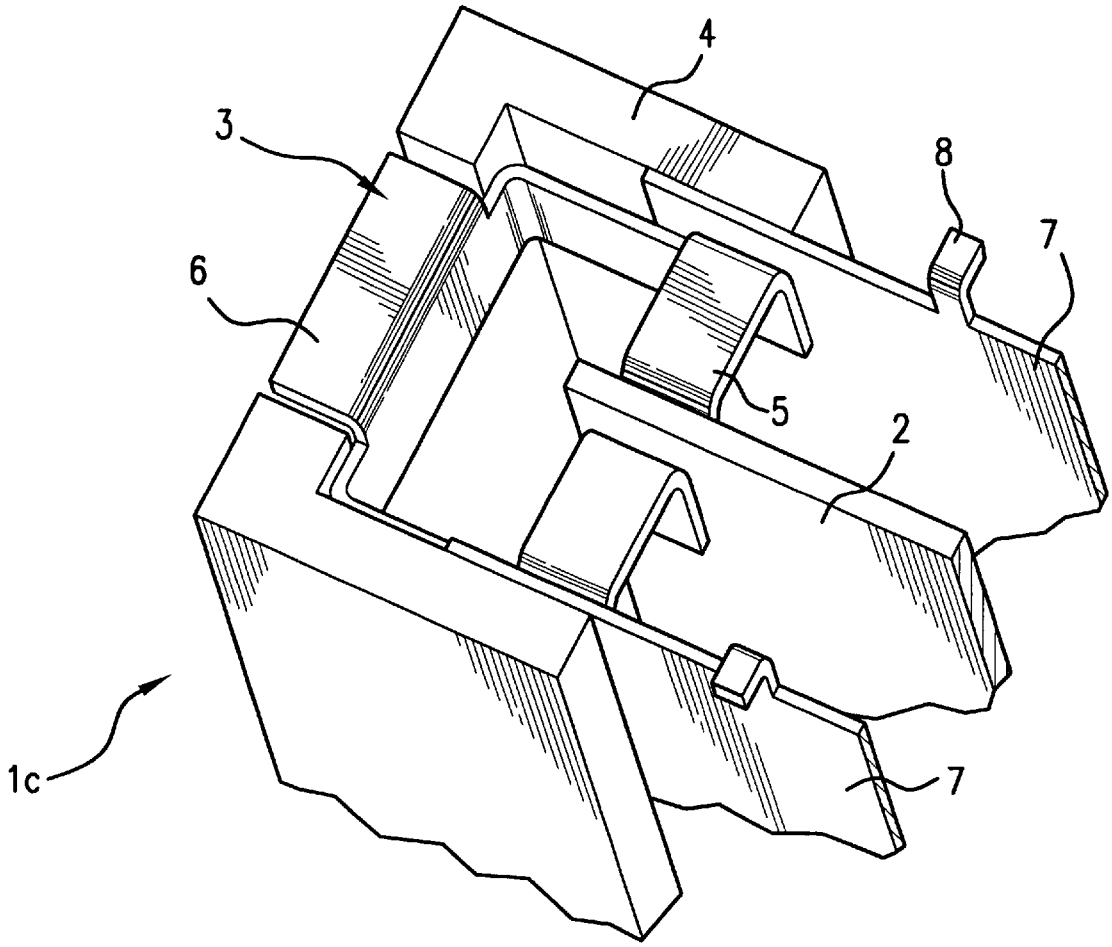
FIG. 5 is a perspective view of part of a multiple pole connector with shield plates according to the fourth embodiment of the invention.

FIG. 5 shows a multiple pole connector with a shield plate according to the fourth embodiment of the invention. This connector 1*c* is different from the connector 1*a* of FIG. 3 in that a plurality of fixing pieces 8 extend outwardly from the bottom edges of the outer shield plates 7. This connector, too, facilitates the pole number development and improves the ground property. The central and outer shield plates 2 and 7 are grounded by using at least one of the extended section 6, the press-fit sections 5, and the fixing pieces 8 of the outer shield plates 7. This connector functions in the same way as in the above embodiments and further description will be omitted.

According to the invention there is provided a multiple pole connectors capable of facilitating the pole number development and having excellent ground performance and thus causing few electromagnetic interference. Also, the connector is grounded without providing a through-hole in the board.

What is claimed is:

1. A multiple pole connector with a shield plate, comprising:

a central shield plate provided at a center of and along a length of said connector and having a flat rectangular shape; and a metal support fixing and connecting said connector to a board without use of any through-hole provided in said board and having a pair of press-fit sections extending inwardly such that said central shield plate is press fitted between said pair of said press-fit sections for electrical connection with a ground of said board.

2. The connector according to claim 1, wherein said metal support is provided with an outwardly extended section which is solderable to said ground without using a through-hole.

3. The connector according to claim 1, which further comprises at least one outer shield plate provided outside said central shield plate along said length of said connector.

4. The connector according to claim 3, wherein said metal support is provided with an outwardly extended section which is solderable to said ground without using a through-hole.

5. A multiple pole connector with shield plates, comprising;

a central shield plate provided at a center of and along a length of said connector and having a flat rectangular shape;

at least one outer shield plate provided outside said center shield plate along said length of said connector and having at least one fixing piece extending outwardly for soldering and electrically connecting said outer shield plate to a ground of a board without using a through-hole; and a metal support for electrically connecting said center shield plate to said outer shield plate.

6. The connector according to claim 5, wherein said metal support is electrically connected to said ground.

7. The connector according to claim 5, wherein said metal support is fixed to said connector and soldered to said board to thereby reinforce said connector.

8. The connector according to claim 5, wherein said metal support is provided with an outwardly extended section which is solderable to said ground.

* * * * *